US006334422B1

(12) United States Patent
Sumi et al.

(10) Patent No.: US 6,334,422 B1
(45) Date of Patent: Jan. 1, 2002

(54) LUBRICATING OIL FEED PASSAGE STRUCTURE IN CRANK SHAFT

(75) Inventors: Hiromi Sumi; Shinya Wakabayashi, both of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/496,589

(22) Filed: Feb. 2, 2000

(30) Foreign Application Priority Data

Feb. 2, 1999 (JP) ..... 11-025125

(51) Int. Cl.[7] ..... F01M 1/00
(52) U.S. Cl. ..... 123/196 R; 184/6.5
(58) Field of Search ..... 123/196 R; 184/6.5

(56) References Cited

FOREIGN PATENT DOCUMENTS

| | | |
|---|---|---|
| DE | 3338506 | 5/1985 |
| EP | 0816643 | 1/1998 |
| GB | 15380 | 11/1911 |
| GB | 105387 | 4/1917 |
| GB | 2086532 | 5/1982 |
| JP | A-953704 | 2/1997 |

*Primary Examiner*—Noah Kamen
(74) *Attorney, Agent, or Firm*—Birch, Stewart, Kolasch & Birch, LLP

(57) ABSTRACT

A lubricating oil feed passage in a crank shaft, having lubricating oil passages formed in the crank shaft and having an inlet end and an outlet end which is open to a connection surface of a crank pin for connection with a connecting rod, a bolt secured to an end portion of the crank shaft so as to project in an axial direction of the crank shaft from an end face of the shaft end portion, and a lubricating oil introducing passage formed axially through the bolt and connected to the inlet end.

11 Claims, 2 Drawing Sheets

LUBRICATING OIL FEED PASSAGE STRUCTURE IN CRANK SHAFT

BACKGROUND OF THE INVENTION

1. Field of the Invention

The present invention relates to a lubricating oil feed passage structure formed in a crank shaft of an internal combustion engine, more particularly, to a lubricating oil feed passage for feeding a lubricating oil to a connection surface for connection with a connecting rod connected to a crank pin.

2. Background Art

Heretofore, taught is a lubricating oil feed passage structure formed in a crank shaft of an internal combustion engine for feeding a lubricating oil to a connection surface. The connection surface is in connection with a large end portion of a connecting rod that is connected to a crank pin. The foregoing disclosed in Japanese Unexamined Patent Publication No. Hei 9-53704.

According to the technique disclosed in the publication, as shown in FIG. 2, a driving sprocket d, on which is entrained a cam chain for driving a cam shaft, is implemented for driving intake and exhaust valves. A primary driving gear e and an oil pump or cooling water pump driving gear f are splined to an end portion of a crank shaft a, which extends from a crank journal b toward a crank case cover c. They are tightened and fixed with a nut g through a washer.

In the crank shaft a, there are formed a lubricating oil passage having a passage i extending coaxially with the crank shaft a, a passage m extending from the passage i and reaching a hollow portion k of a crank pin j, and a passage p which extends from the hollow portion k and is open to a connecting rod connection surface of the crank pin j with a large end portion n of the connecting rod being connected to the connection surface through a bearing. A tip end of the crank shaft end portion is received in a lubricating oil chamber r formed in the crank case cover c. An oil seal s, which is fixed to an open end of the lubricating oil chamber r, comes into sliding contact with an outer periphery of the tip end of the crank shaft end portion to prevent the lubricating oil present in the lubricating oil chamber from leaking through the tip end outer periphery.

Via the lubricating oil feed structure formed in the crank shaft a, the lubricating oil, fed from an oil pump into the lubricating oil chamber r through a filter, flows through an opening formed in the end face of the crank shaft end portion. The lubricating oil flows further through the lubricating oil passages i, m, k, p, and is fed between the connecting rod connection surface of the crank pin j and the bearing for the large connecting rod end portion n to lubricate the sliding portion.

In the background art described above, the passage i, formed toward the crank arm h, from the end face of the crank shaft end portion and extending coaxially with the crank shaft a, is a long passage because it passes through a relatively long shaft end portion. In the long shaft and portion are formed the mounting portion for the driving sprocket d, a primary driving gear e, an auxiliary device driving gear f, and the mounting portion for the nut g and the tip end portion extending up to the lubricating oil chamber r, formed in the crank case cover c. Therefore, due to the complex structure, the boring process for forming such a long passage system is very difficult.

SUMMARY OF THE INVENTION

In view of the deficiencies of the background art, it is an object of the present invention to provide a lubricating oil feed passage structure wherein a lubricating oil introducing member is mounted to shorten an end portion of the crank shaft and thereby facilitate machining of the lubricating oil passage to be formed in the crank shaft.

A further object of the present invention is to shorten the crank shaft end portion to a greater extent and ensure a fixed state of the torque transfer member by utilizing a bolt which serves as a lubricating oil introducing member and which functions to fix the torque transfer member.

In addition, an object of the present invention is to provide a case where the spacing between the end face of the crank shaft end portion and the lubricating oil chamber differs depending on the model of a vehicle.

These objects and other objects of the present invention are accomplished by providing a lubricating oil feed passage structure in a crank shaft, having a lubricating oil passage formed in the crank shaft which has a crank pin with a connecting rod connected thereto, the lubricating oil passage having an inlet end and an outlet end which is open to a connection surface for connection with the connecting rod of the crank pin; a lubricating oil introducing member mounted at an end portion of the crank shaft so as to project in an axial direction of the crank shaft from an end face of the crank shaft end portion; and a lubricating oil introducing passage formed axially through the lubricating oil introducing member and connected to the inlet end.

Therefore, since the lubricating oil is introduced into the lubricating oil passage of the crank shaft through the lubricating oil introducing passage formed in the lubricating oil introducing member which is mounted so as to project in the axial direction of the crank shaft from an end face of the crank shaft end portion, the length of the crank shaft end portion becomes smaller than in the background art device by an amount corresponding to the length of the lubricating oil introducing member projecting from the end face of the crank shaft end portion, so that the length of the lubricating oil passage formed in the shaft end portion becomes smaller and hence the machining for the lubricating oil passage to be formed in the crank shaft becomes easier.

Moreover, in the lubricating oil feed passage structure, the lubricating oil introducing member is a bolt which prevents the torque member from moving in the axial direction of the crank shaft, and thus the bolt is utilized also as a lubricating oil introducing member, so the length of the crank shaft end portion can be made smaller by an amount corresponding to the length of the bolt projecting from the end face of the crank shaft end portion. In the projecting bolt length is also included the length of the nut mounting portion in the background art. As a result, the length of the lubricating oil passage formed in the crank shaft becomes still smaller and therefore the machining for the passage becomes easier. Moreover, since the torque transfer member is tightened with the bolt, the bolt becomes difficult to loosen under the action of an elastic force developed in the bolt itself, whereby the movement of the torque transfer member in the axial direction of the crank shaft is prevented more positively.

Furthermore, in the lubricating oil feed passage structure, the head of the aforesaid bolt has a cylindrical portion, which is positioned within the lubricating oil chamber formed in the crank case cover. Thus, since the cylindrical bolt head portion gets into the lubricating oil chamber, even in the case where the spacing between the end face of the crank shaft end portion and the lubricating oil chamber differs, depending on the model of a vehicle for example, it is possible to cope with such a case easily by providing a plurality of bolts different in the length of the cylindrical portion, therefore, the need of changing the crank shaft is not required.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An embodiment of the present invention will be described herein under with reference to FIG. 1.

Figure 1:
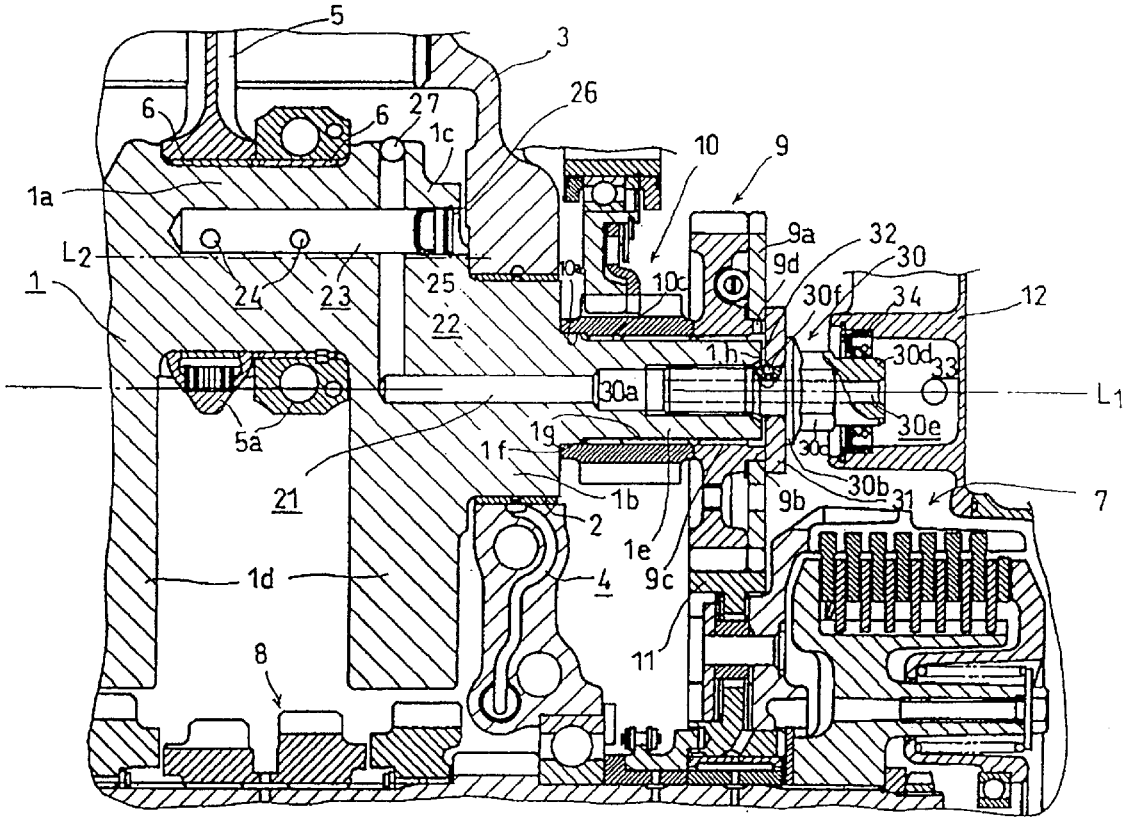
FIG. 1 is a sectional view of a crank shaft and a crank case in an internal combustion engine, illustrating a lubricating oil feed passage structure formed in the crank shaft according to an embodiment of the present invention.

A lubricating oil feed passage structure in a crank shaft according to the first embodiment of the present invention, which is illustrated in FIG. 1, is applied to a crank shaft 1 of an overhead camshaft type V-shaped 2-cyliner internal combustion engine mounted on a vehicle such as a motorcycle. The crank shaft 1 is supported by a crank case 3 which is divided into upper and lower halves through two right and left bearings 2 (only the right-hand one is shown) serving as main bearings. Passages 4 for feeding a lubricating oil to the bearings 2 are formed respectively in support portions for the bearings 2 of the crank case 3.

The crank shaft 1 includes crank pins 1*a,* crank journals 1*b,* crank arms 1*c,* and balance weights 1*d,* which are formed integrally by molding. Large end portions 5*a* of connecting rods 5, whose small end portions are pivotally secured to piston pins mounted to pistons of the cylinders, are respectively connected to the crank pins 1*a* in an adjacent manner. More specifically, the large end portions 5*a* of the connecting rods are slidably fitted on outer peripheries of the crank pins 1*a* serving as connection surfaces for connection with the connecting rods 5, through bearings 6 fixed to inner peripheries of the crank pins 1*a*. A lubricating oil is fed between the connecting rods 5 and the connection surfaces of the crank pins 1*a* to diminish a frictional resistance induced between the two.

On the other hand, a reciprocating motion of each piston transferred through the associated connecting rod 5 is converted to a rotational motion and the resulting torque of the crank shaft 1 is transmitted to a rear wheel via a multiple-disc friction clutch 7, a constant mesh type gear transmission 8 and a driving chain. In this case, the transfer of the torque between the crank shaft 1 and the multiple disc friction clutch 7 is performed by a primary reduction mechanism having a primary driving gear 9 splined to an end portion 1*e* of the crank shaft 1 and a primary driven gear 11 connected to a clutch housing of the multiple-disc friction clutch 7 through a damper.

The primary driving gear 9 has a primary sub gear 9*a* connected thereto through an elastic member which is a spring for the purpose of eliminating backlash between it and the primary driven gear 11. The primary sub gear 9*a* is fitted on an outer periphery of a boss portion 9*b* formed on a thrust washer 31 side, to be described later, of the primary driving gear 9. An end face of the primary sub gear 9*a* and that of the boss portion 9*b* are capable of coming into abutment against the thrust washer 31.

The end portion 1*e* of the crank shaft 1 is constituted of a portion of the crank shaft 1 which portion extends from the right-hand crank journal 1*b* toward a right-hand crank case cover 12. An outer periphery of the shaft end portion 1*e* has an outer peripheral portion 1*f* and a spline portion 1*g,* the outer peripheral portion 1*f* being positioned near a crank journal 1*b* and having a smooth circumferential surface. The spline portion 1*g* is formed as a small-diameter portion which extends from the outer peripheral portion 1*f* toward an end face 1*h* of the shaft end portion 1*e,* and has an outside diameter smaller than that of the outer peripheral portion 1*f*. The spline portion 1*g* comprises a plurality of spline Grooves and spline ridges formed in parallel with a crank shaft axis L1. Thus, the outside diameter of the outer peripheral portion 1*f* is set-larger than that of the spline ridges of the spline portion 1*g*.

Onto the outer periphery of the shaft end portion 1*e* are mounted a cam shaft driving timing gear 10 and the primary driving gear 9, successively from the right-hand crank journal 1*b* side. The timing gear 10 and the primary driving gear 9 have spline portions 10*c* and 9*c* formed on respective inner peripheries, the spline portions 10*c* and 9*c* having a plurality of spline ridges and grooves to be respectively engaged with the spline grooves and ridges of the shaft end portion 1*e*. Thus, both gears 9 and 10 are connected to the crank shaft 1 so as to be unmovable in the rotating direction of the crank shaft, and integrally rotatable with the crank shaft. Movement of both gears 9 and 10 in the direction of the crank shaft axis L1 is prevented by a crank center bolt 30 which is mounted to the shaft end portion 1*e,* which will be described later. Since the spline portion 1*b* of the crank shaft 1 and the spline portions 9*c* and 10*c* of both gears 9 and 10 are fitted together, the torque of the crank shaft 1 is transmitted to both gears 9 and 10 via the plural spline ridges, so that wear of the torque transfer surface can be diminished. Consequently, it is possible to effect the transfer of a large torque and also possible to continue the transfer of a desired magnitude of torque over a long period. The gears 9 and 10 constitute a torque transfer member to which the torque of the crank shaft 1 is transferred and which transmits the torque to the cam shaft or the multiple-disc friction clutch 7.

On the inner periphery of the timing gear 10, at a position close to the right-hand crank journal 1*b,* is formed an inner peripheral portion 10*a* having a smooth circumferential surface to be fitted with the outer peripheral portion 1*f* which is formed at the shaft end portion 1*e*. Since the outer peripheral portion 1*f* and the inner peripheral portion 10*a* are fitted together by clearance fit, there is performed an accurate centering of the timing gear 10 with respect to the crank shaft 1. A more accurate centering can be effected by subjecting the outer and inner peripheral portions 1*f,* 10*a* to abrasive machining. By this centering operation, vibration of the timing gear relative to the crank shaft 1 is prevented and hence the generation of noise based on the vibration is suppressed. Besides, the work for fitting the outer peripheral portion 1*f* and the inner peripheral portion 10*a* is simple because of clearance fit. Furthermore, since the outside diameter of the outer peripheral portion 1*f* is larger than that of the spline portion 1*g* of the crank shaft 1, the fitting of the outer and inner peripheral portions 1*f*, 10*a* can be done without being influenced by splining at the spline portion 1*g*, thus permitting a more accurate centering work. On the other hand, the rotation of the timing gear 10 is transmitted through a series of gears to a cam shaft installed in the cylinder head, and intake and exhaust valves are driven in accordance with rotation of the cam shaft.

The following description is now provided about the lubricating oil passage.

A bottomed, stepped hole 21 extending from the end face 1*h* of the shaft end portion 1*e* toward the crank arm 1*c*, having a small-diameter portion and a large-diameter portion and having an axis aligned with the crank shaft axis L1, is formed by drilling from the end face 1*h* of the shaft end portion 1*e*. The small-diameter portion of the stepped hole 21 is located at a position close to the crank arm 1*c* (close to the bottom), while the large-diameter portion of the hole 21 is positioned close to the end face 1*h* of the shaft end portion 1*e* (close to the open end). The peripheral wall of the large-diameter portion is internally threaded at a portion thereof close to the open end and the crank center bolt 30, which will be described later, comes into engagement with the internal threads. The stepped hole 21 thus formed constitutes a first lubricating oil passage 21 for feeding the lubricating oil to the foregoing connection surface of the crank pin 1*a*.

In the crank pin 1*a* is formed a bottomed hole 23 by drilling from the right-hand side of the crank arm 1*c*, the bottomed hole 23 extending from the right-hand side of the right-hand crank arm 1*c* toward the crank pin 1*a* and having an axis parallel to a crank pin axis L2. The axis of the hole 23 lies on a plane including both crank pin axis L2 and crank shaft axis L1 and is positioned on the side opposite to the crank shaft axis L1 with respect to the crank pin axis L2. The diameter of the hole 23 is set larger than the diameter of the small-diameter portion of the stepped hole 21 and thus the hole 23 functions to store the lubricating oil which has entered the hole. Therefore, the lubricating oil can be fed stably to the foregoing connection surface of the crank pin 1*a* through a fourth lubricating oil passage 24, which will be described later. The portion of the hole 23 closer to the open end with respect to a portion where the hole 23 crosses a second lubricating oil passage 22, which will be described later. The hole 23 thus formed constitutes a third lubricating oil passage 23 for feeding the lubricating oil to the foregoing connection surface of the crank pin 1*a*.

A passage portion of the third lubricating oil passage 23 positioned closer to the open end with respect to a cup-like member 25 is set larger in diameter than the other passage portion of the third lubricating oil passage 23, and in its circumferential wall is formed an annular groove in which a clip 26 is fitted by virtue of an elastic force thereof. The clip 26 prevents the cup-like member 25 from coming off of the third lubricating oil passage 23.

A hole 22, forming the second lubricating passage 22, is formed by drilling from an outer peripheral portion of the crank arm 1*c*, close to the crank pin 1*a*. The hole 22 extends from the outer peripheral portion toward the balance weight 1*d*, through the third lubricating oil passage 23 and reaches an innermost portion of the first lubricating oil passage 21 (the bottom of the small-diameter portion of the stepped hole 21). The hole 22 has an axis perpendicular to the axes of the first and third lubricating oil passages 21, 23 and has the same diameter as the diameter of the small-diameter portion of the stepped hole 21. A portion of the hole 22, located closer to the open end with respect to the portion where the hole 22 crosses the third lubricating oil passage 23, is closed by a ball member 27 which is a sealing plug. The hole 22 thus formed constitutes the second lubricating oil passage 22 for feeding the lubricating oil to the foregoing connection surface of the crank pin 1*a*.

By drilling from the connection surface side of each crank pin 1*a* there are formed two holes 24, forming the forth oil passage 24, which are open to the third lubricating oil passage 23 in the portion corresponding to the large end portion 5*a* of each connecting rod 5. The holes 24 constitutes a fourth lubricating oil passage 24 for feeding the lubricating oil to the connection surface. With the lubricating oil flowing out from the fourth lubricating oil passage 24 there is effected lubrication between the bearing 6 at the large end portion 5*a* of the connecting rod 5 and the connection surface.

The above first to fourth lubricating oil passages 21, 22, 23, 24 constitute the lubricating oil passage formed in the crank shaft 1. The portion of the first lubricating oil passage 21 adjacent to an end face of a shaft portion 30*a* of the crank center bolt 30 corresponds to an inlet end of the lubricating oil passage formed in the crank shaft, while an open end of the fourth lubricating oil passage 24 located on the foregoing connection surface side corresponds to an outlet end of the lubricating oil passage formed in the crank shaft.

External threads formed on the shaft portion 30*a* of the crank center bolt 30 come into threaded engagement with the internal threads formed in the large-diameter portion of the stepped hole 21, whereby the crank center bolt 30 is secured to the end portion 1*e* of the crank shaft 1. The head of the crank center bolt 30 comprises a hexagonal prism portion adjacent to the shaft portion 30*a* and formed with a flange portion 30*b* and a cylindrical portion 30*d* extending axially from the hexagonal prism portion 30*c*.

A lip portion of an oil seal 34 comes into sliding contact with the outer periphery of the cylindrical portion 30*d*, as will be described later, so the outer periphery of the cylindrical portion 30*d* is subjected to abrasive machining for smoothing the sliding contact portion.

In the crank center bolt 30 is formed a through hole 30*e* from an end face of the cylindrical portion 30*d* of the bolt head toward, the end face of the shaft portion 30*a*, the through hole 30*e* having an axis aligned with the axis of the crank center bolt 30, and hence, aligned with the axis of the crank shaft axis L1. The trough hole 30*e* thus formed constitutes a lubricating oil introducing passage 30*e* which is connected to the inlet end of the lubricating oil passage formed in the crank shaft 1.

The crank center bolt 30, with a thrust washer 31 fitted thereon, is brought into threaded engagement with the internal threads of the stepped hole 21 by means of a tool which is applied to the hexagonal prism portion 30*c*. As a result, of the crank center bolt 30 being tightened, an end face of, the timing gear 10 on the crank journal 1*b* side comes into abutment against an end face of the crank journal 1*b*, an end face of the timing gear 10 on the primary driving gear 9 side and an end face of the primary driving gear 9 on the timing gear 10 side come into abutment against each other. Moreover, an end face of the primary driving gear 9 on the thrust washer 31 side and an end face of the boss portion 9*b* on the thrust washer 31 side come into abutment against the thrust washer 31, whereby the timing gear 10 and the primary driving gear 9 both mounted on the shaft end portion 1*e* are prevented from moving in the crank axis L1 direction, as noted previously.

Moreover, as the crank center bolt 30 is tightened, a tensile force is exerted between the external threads and the flange 30*b* of the crank center bolt, so that in this portion there occurs a slight elongation within an elastic region. Consequently, an elastic force based on the elongation acts on the internal threads of the large-diameter portion of the stepped hole 21 and also on the external threads of the crank center bolt 30 which are threadedly engaged with each other, so that the prevention against loosening of the bolt 30 is improved Accordingly, the inhibited state of the timing gear 10 and the primary driving gear 9 from moving in the crank axis L1 direction is ensured.

Furthermore, with both gears 9 and 10 fixed by the bolt 30, a slight gap 32 is formed between the end face 1*h* of the end portion 1*e* of the crank shaft 1 and the thrust washer 31. In order that the lubricating oil may be fed through the gap 32 to the fitted portion between the inner periphery of the primary sub gear 9*a* and the outer periphery of the boss portion 9*b* of the primary driving gear 9, a first oil hole 30*f*, which is open not only to the lubricating oil introducing passage 30*e*, but also to the gap 32, is formed in the shaft portion 30*a* of the crank center bolt 30 in the vicinity of the portion where the thrust washer 31 is fitted thereon. The first oil hole 30*f* is formed perpendicularly to the axis of the lubricating oil introducing passage 30*e*, and also formed is a second oil hole 9*d* extending radially through the fitted portion of the boss portion 9*b*. Therefore, a portion of the lubricating oil flowing through the lubricating oil introducing passage 30*e* passes through the first oil hole 30*f* and the gap 32, further passes through the second oil hole 9*d* and is fed to the fitted portion of the primary sub gear 9*a* and the boss portion 9*b* of the primary driving gear 9.

Figure 2:
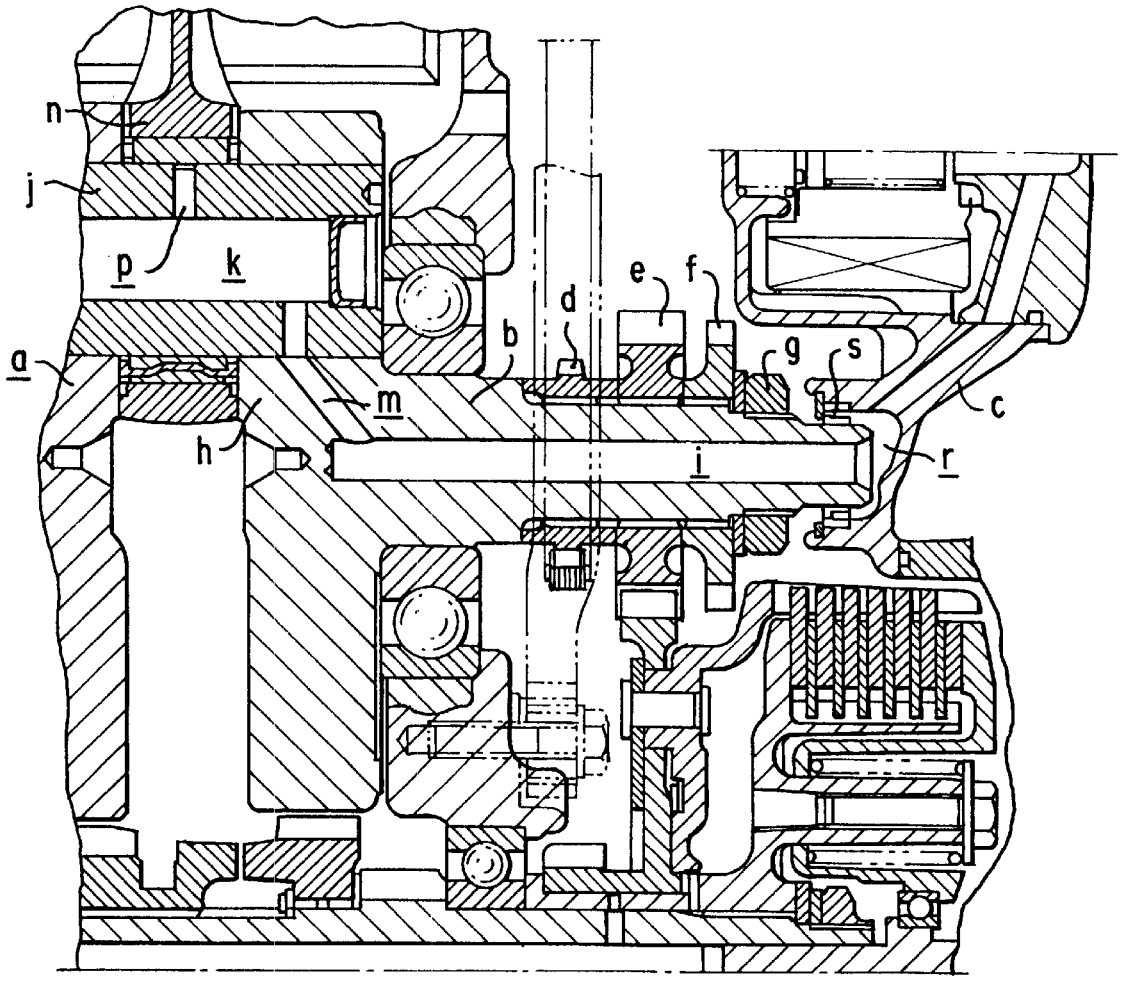
Fig. 2 PRIOR ART
FIG. 2 is a sectional view of a crank shaft and a crank case in an internal combustion engine, illustrating a conventional lubricating oil feed passage structure formed in the crank shaft.

Thus, the crank center bolt 30 not only functions as a fixing member for fixing the timing gear 10 and the primary driving gear 9 as torque transfer members, but also functions as a lubricating oil introducing member for introducing the lubricating oil to the lubricating oil passage formed in the crank shaft. In this embodiment, therefore, as compared with the background art shown in FIG. 2, the length of the end portion 1*e* of the crank shaft 1 is smaller by a distance corresponding to the projecting length of the crank center bolt 30 from the end face 1*h* of the shaft end portion 1*e*. Consequently, the length of the first lubricating oil passage 21 formed in the crank shaft 1 also becomes shorter than in the background art, thus facilitating machining for the same passage.

Inside the right-hand crank case cover 12 is formed a recess as a lubricating oil chamber 33. With the right-hand cover 12 attached to the crank case 3, the lubricating oil chamber 33 is positioned on the crank shaft axis L1 and hence on the axis of the lubricating oil introducing passage 30*e* formed in the crank center bolt 30, and is open toward the crank shaft 1. The position of the lubricating oil chamber 33 permits the cylindrical portion 30*d* of the crank center bolt head to enter into the same chamber. In this state, the oil seal 34 is fixed to an open end portion of the lubricating oil chamber 33 and the lip portion thereof is in sliding contact with the polished outer periphery of the cylindrical portion 30*d* positioned within the lubricating oil chamber 33. This design provides a liquid-tight seal between the open end portion of the lubricating oil chamber 33 and the cylindrical portion 30*d*, thus preventing the lubricating oil present in the lubricating oil chamber 33 from leaking through the outer periphery of the cylindrical portion 30*d*.

Now, a description will be given below about how the lubricating oil flows in this embodiment.

The lubricating oil, which is pressurized by the oil pump, passes through the filter and the passage formed in the right-hand crank case cover 12, and is fed into the lubricating oil chamber 33 formed in the cover 12. The lubricating oil present in the lubricating oil chamber 33 flows through the lubricating oil introducing passage 30*e* formed in the crank center bolt 30, enters the first lubricating oil passage 21 formed in the crank shaft 1, passes through the second, third and fourth lubricating oil passages 22, 23, 24, and then is discharged to the connection surface of the crank pin 1*a* and fed between the bearing 6 at the large end portion 5*a* of each connecting rod 5 as a sliding portion and the connection surface of the crank pin 1*a*. A portion of the lubricating oil introduced into the lubricating oil introducing passage 30*e*, as described previously, passes through the first oil hole 30*f*, the gap 32, and the second oil hole 9*d* and is fed to the fitted portion of the primary sub gear 9*a* and the boss portion 9*b* of the primary driving gear 9.

Since this embodiment is constructed and operates as disclosed hereinabove, there are attained the following effects. Since the lubricating oil is taken into the lubricating oil passage formed in the crank shaft 1 through the lubricating oil introducing passage 30*e* formed in the crank center bolt 30 which projects in the crank shaft axis L1 direction from the end face 1*h* of the end portion 1*e* of the crank shaft 1, the length of the end portion 1*e* of the crank shaft 1 becomes smaller than in the background art by a distance corresponding to the projecting length of the crank center bolt 30 from the end face 1*h* of the end portion 1*e* of the crank shaft 1. Consequently, the lubricating oil passage formed in the shaft end portion 1*e* becomes shorter and so the machining for the lubricating oil passage to be formed in the crank shaft 1 is simplified.

Moreover, because the lubricating oil introducing passage 30*e* is formed in the crank center bolt 30 which prevents the timing gear 10 and the primary driving gear 9 from moving in the crank shaft axis L1 direction, the crank center bolt 30 as a single member not only functions as a fixing member for fixing the timing gear 10 and the primary driving gear 9, but also functions as a lubricating introducing member for introducing the lubricating oil into the lubricating oil passage, thus making it possible to reduce the number of components used in the construction of the embodiment.

Additionally, since the timing gear 10 and the primary driving gear 9 are tightened by the crank center bolt 30, the bolt 30 becomes difficult to loosen under the action of an elastic force which is created in the bolt 30 itself, so that the movements of both gears 9 and 10 in the crank shaft axis L1 direction are inhibited more positively.

Furthermore, since the cylindrical portion 30*d* of the head of the crank center bolt 30 impinges the lubricating oil chamber 33 formed in the right-hand crank case cover 12, it is possible to easily cope with a case where the spacing between the end face 1*h* of the crank shaft end portion 1*e* and the lubricating oil chamber 33 differs depending on the model of a vehicle, thereby overcoming the need of changing the crank shaft 1, by providing a plurality of crank center bolts 30 different in length of the cylindrical potion 30*d*.

In addition, since the lip portion of the oil seal 34 comes into sliding contact with the polished portion of the cylindrical portion 30*d* at the head of the crank center bolt 30, it is possible to prevent the lubricating oil from leaking through the outer periphery of the cylindrical portion 30*d*. In addition to this construction, a portion of the lubricating oil which has been introduced into the lubricating oil introducing passage 30*e* formed in the crank center bolt 30 passes through the first oil hole 30*f*, gap 32 and second oil hole 9*d* and is fed to the fitted portion of the primary sub gear 9*a* and the boss portion of the primary driving gear 9. Thus, the fitted portion can be lubricated by such a simple constitution.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lubricating oil feed passage structure for a crank shaft, comprising:

a lubricating oil passage formed in the crank shaft having a crank pin with a connecting rod connectable thereto, said lubricating oil passage having an inlet end and an outlet end, said outlet end being open to a connection surface for connection with the connecting rod of the crank pin;

a lubricating oil introducing member threadedly mounted at an end portion of the crank shaft so as to project in an axial direction of the crank shaft from an end face of the crank shaft end portion; and a lubricating oil introducing passage formed axially through said lubricating oil introducing member and connected to said inlet end, wherein said lubricating oil introducing member is a bolt which prevents a torque transfer member from moving in the axial direction of the crank shaft, said torque transfer member being mounted to said crank shaft end portion.

2. The lubricating oil feed passage structure for a crank shaft according to claim 1, wherein a head of said bolt has a cylindrical portion, said cylindrical portion being positioned within a lubricating oil chamber formed in a crank case cover.

3. The lubricating oil feed passage structure for a crank shaft according to claim 1, wherein said lubricating oil passage structure includes first, second, third and forth lubricating oil passage portions.

4. The lubricating oil feed passage structure for a crank shaft according to claim 3, wherein said first lubricating oil passage portion is aligned along an axis of the crank shaft.

5. The lubricating oil feed passage structure for a crank shaft according to claim 3, wherein said first lubricating oil passage portion extends in a direction parallel to an axis of the crank shaft, said second lubricating oil passage portion extends in a direction substantially perpendicular to said first lubricating oil passage portion, and said third lubricating passage portion extends parallel to an axis of the crank pin and lies on a plane including both the crank pin and crank shaft axes.

6. The lubricating feed passage structure for a crank shaft according to claim 3, wherein said forth lubrication oil passage portion is formed utilizing two separate holes connectively attached to said third lubrication oil passage portion, said forth lubrication oil passage portion constituting said outlet end being open to the connection surface for connection with the connecting rod of the crank pin.

7. A lubricating feed passage structure for a crank shaft, comprising:

a plurality of lubricating feed passages disposed in the crank shaft;

a lubrication oil introducing member mounted to an oil inlet end of said plurality of lubricating feed passages, said lubrication oil introducing member having a first portion and a second portion extending therefrom in a direction away from said plurality of lubricating feed passages; and a lubricating oil chamber adjacent to said lubrication introducing member, said lubrication oil chamber receiving said second portion in an opening formed therein, wherein disposed in said lubrication oil introducing member and through both the first and second portions is a oil introducing passage connecting said lubricating oil chamber with the oil inlet end of said plurality of lubricating feed passages, wherein said lubricating oil introducing member is a bolt which prevents a torque transfer member from moving in the axial direction of the crank shaft, said torque transfer member being mounted to a crank shaft end portion.

8. The lubricating oil feed passage structure for a crank shaft according to claim 7, wherein said plurality of lubricating feed passages are four distinct lubricating feed passage portions disposed in the crank shaft, two of said four distinct lubricating feed passage portions have an axis parallel an axis of the crank shaft.

9. The lubricating oil feed passage structure for a crank shaft according to claim 7, wherein said first portion is a flange member and said second portion is a cylindrical member.

10. The lubricating oil feed passage structure for a crank shaft according to claim 7, wherein positioned between the first portion and an end face of the crank shaft is washer.

11. The lubricating oil feed passage structure for a crank shaft according to claim 7, wherein one of said plurality of feed passages includes at an end thereof an internally threaded portion for receiving an external threaded portion of said lubrication oil introducing member.

* * * * *